US011982027B2

(12) United States Patent
Devaraj

(10) Patent No.: US 11,982,027 B2
(45) Date of Patent: May 14, 2024

(54) TERRY FABRIC WITH NON-UNIFORM/DIFFERENTIAL PICK DENSITY AND METHOD THEREOF

(71) Applicant: Vikram Krishna Devaraj, Coimbatore (IN)

(72) Inventor: Vikram Krishna Devaraj, Coimbatore (IN)

( * ) Notice: Subject to any disclaimer, the term of this patent is extended or adjusted under 35 U.S.C. 154(b) by 72 days.

(21) Appl. No.: 17/908,732

(22) PCT Filed: Mar. 11, 2021

(86) PCT No.: PCT/IN2021/050238
§ 371 (c)(1),
(2) Date: Sep. 1, 2022

(87) PCT Pub. No.: WO2021/181418
PCT Pub. Date: Sep. 16, 2021

(65) Prior Publication Data
US 2023/0160111 A1 May 25, 2023

(30) Foreign Application Priority Data
Mar. 11, 2020 (IN) ..... 202041010381

(51) Int. Cl.
*D03D 27/08* (2006.01)
*D03D 1/00* (2006.01)
*D03D 13/00* (2006.01)

(52) U.S. Cl.
CPC ..... *D03D 27/08* (2013.01); *D03D 1/0017* (2013.01); *D03D 13/008* (2013.01); *D10B 2503/00* (2013.01)

(58) Field of Classification Search
CPC .... D03D 27/08; D03D 1/0017; D03D 13/008; D10B 2503/00
See application file for complete search history.

(56) References Cited

U.S. PATENT DOCUMENTS 4,566,498 A * 1/1986 Williams ..... D03D 39/226 139/26
4,576,848 A * 3/1986 Dillon ..... D06C 23/02 428/95

(Continued)

FOREIGN PATENT DOCUMENTS

| | | | |
|---|---|---|---|
| CA | 3041902 | A1 | 11/2019 |
| DE | 3035926 | A1 | 5/1982 |
| WO | 2019213382 | A1 | 11/2019 |

OTHER PUBLICATIONS

International Search Report & Written Opinion dated Jun. 18, 2021 from PCT Application No. PCT/IN2021/050238.

*Primary Examiner* — Robert H Muromoto, Jr.
(74) *Attorney, Agent, or Firm* — INNOVATION CAPITAL LAW GROUP, LLP; Vic Lin

(57) ABSTRACT

The present invention generally relates to the field of textiles. More particularly, it relates to A woven terry cloth with differential or non uniform pick density having different picks per centimeter and method for producing the same with controlled weight distribution. The terry fabric with differential pick density, having: a body comprising of one or more ends of first end (L1) and second end (L2), one or more edges of first side edge (W1) and second side edge (W2), and a plurality of zones (Z1, Z2, Z3); a plurality of ground warp ends (G1, G2); a plurality of terry pile loop yarn (P1, P2); and a plurality of ground fill picks (f1, f2, f3, f4, f5, f6, f7, f8). Additionally the woven terry cloth includes variable density of picks in different zones of the fabric.

24 Claims, 3 Drawing Sheets

(56) References Cited

U.S. PATENT DOCUMENTS 5,336,543 A * 8/1994 Pyle ..... A47K 10/02 428/95
6,550,115 B1 4/2003 Skoog et al.
7,069,960 B2 * 7/2006 Nakada ..... D03D 39/223 139/105
7,309,667 B2 12/2007 Schindler et al.
7,673,656 B2 * 3/2010 Heiman ..... D03D 27/08 139/420 R
9,850,599 B2 12/2017 Stewart
10,072,364 B2 * 9/2018 Goenka ..... D03D 27/08
10,161,068 B2 * 12/2018 Wang ..... D03D 27/06
10,287,714 B2 * 5/2019 Mandawewala ..... D03D 15/217
10,463,203 B2 * 11/2019 Hozumi ..... D03D 13/008
2002/0197445 A1 * 12/2002 Eccles ..... D03D 27/00 139/391
2004/0099325 A1 * 5/2004 Nakada ..... D03D 49/20 139/21
2005/0081939 A1 * 4/2005 Heiman ..... D03D 27/08 139/25
2009/0025818 A1 * 1/2009 Hozumi ..... D03D 27/08 15/210.1
2015/0167210 A1 * 6/2015 Tomlin ..... D02G 3/04 139/420 R
2016/0037977 A1 * 2/2016 Hozumi ..... D03D 27/06 28/162
2016/0305049 A1 * 10/2016 Wang ..... D03D 15/68
2016/0333506 A1 * 11/2016 Goenka ..... D03D 15/47
2017/0088984 A1 * 3/2017 Stewart ..... D03D 27/08
2017/0233904 A1 * 8/2017 Weening ..... D03D 15/513 139/420 R
2018/0266022 A1 * 9/2018 Mandawewala ..... D02G 3/44
2020/0232128 A1 * 7/2020 Lawrence ..... D03D 1/0017
2021/0262124 A1 * 8/2021 Devaraj ..... D02G 3/36
2023/0018097 A1 * 1/2023 Conboy ..... B24D 11/02
2023/0160111 A1 * 5/2023 Devaraj ..... D03D 1/0017 139/2

* cited by examiner

TERRY FABRIC WITH NON-UNIFORM/DIFFERENTIAL PICK DENSITY AND METHOD THEREOF

FIELD OF THE INVENTION

The present invention generally relates to the field of textiles. More particularly, it relates to woven terry cloth with differential or non uniform pick density. The present invention provides for improved terry fabrics comprising different picks per centimeter and method for producing the same with controlled weight distribution. Additionally the present invention relates to variable density of picks in different zones of the fabric.

BACKGROUND OF THE INVENTION

In general woven terry fabrics like bath and hand towels are produced with uniform picks per cm from end to end and side to side. This type uniform construction is achieved with constant picks per centimeter across the length and width of the fabricated finished towel.

Normally when towels are used for wiping water from body after face wash/hand wash/bathing most people tent to use the central portion of the towel to dry their hands, hair, and bodies, and keeping the both end side of the towel remains less used for these purposes and more commonly serve to provide a means by which one holds the towel.

Used/dirt Towels needs significant resources while laundering due to its hydrophilic nature. In general, recommended washing cycles will have specific qty of detergents or soaps to remove dirts, stain, etc and water to rinse at warm conditions. After washing, towels are dried in dryer by means of heat.

There are facilities which provide washing machines on large scale for washing of dirt towels, toweling cloth and launder will charge based on weight of the towels/terry toweling cloth. By exploring the possibility to reduce the weight to reduce the resources and costs to launder the towels and probable option is to reduce the weight of towel. This weight reduction can be achieved by reducing the picks per centimeter in the towels construction.

Total weight of the towel generally determines the rate absorbency of a towel and luxury and often has significant influence on the perception of towel quality. Towels produced with lesser weight due to reduced picks per cm will tend to be less absorbent and less luxurious compared to a heavier weight towel having high picks per cm. Due to above reasons of absorbency and luxurious, in general, hospitality industry where patrons often prefer towels with heavy weight as a sign of quality and luxury.

U.S. Pat. No. 9,850,599 B2 relates to a woven terry fabric with controlled weight distribution and articles made therefrom. Described is a controlled weight distribution woven terry fabric that includes a body having a first end and a second end, wherein the first and second ends are opposite one another and a first side edge 34 and a second side edge, wherein the first and second side edges are opposite one another and generally perpendicular to the first and second opposite ends. The terry fabric further includes a plurality of zones extending across the fabric between one of the first and second opposite ends and the first and second opposite edges. Each zone of the plurality of zones has a pile with a pile height and the pile height in a zone differs from the pile height in an adjacent zone and the difference between the pile heights in adjacent zones is in a range between about 0.1 mm and about 2 mm. Also described are articles, such as towels, wash cloths, and bath mats, made from the controlled weight distribution woven terry fabric.

U.S. Pat. No. 6,550,115 B1 relates to a method for making a hydraulically entangled composite fabric. The present invention desirably provides a fabric including a synthetic fiber structure first zone, a synthetic fiber structure second zone, and a short fiber third zone. The first zone may include a spun bond web layer and a melt blown web layer. The synthetic fiber structure second zone may be positioned proximate to the synthetic fiber structure first zone and the short fiber third zone may be positioned substantially between the first and second zones. Desirably, the first and second zones are entwined.

U.S. Pat. No. 7,309,667 B2 relates to a woven fabric and a method for the production thereof. A fabric includes mutually transverse thread systems, with at least one of the thread systems including a differential shrinkage yarn C. The shrinkage yarn C has at least one effect component a that irreversibly elongates itself upon heat treatment, and at least one shrinkage component B that shortens itself upon heat treatment. The components A and B are bound together by nodes, wherein the number (y) of nodes per meter in the yarn C is predetermined as a function of the yarn count (x) of the transverse thread system so that the number (y) of nodes exceeds a minimum value and increases proportionally above the minimum value as a function of the yarn count (x).

CA3041902 relates to an Engineered knit with multi-density knit zone. A knitted element may include at least three zones. The first zone may include terry loop knitting. The second zone may include mesh knitting. The third zone may include jersey knitting. The knitted element may include at least one seamless transition between the first zone and the second zone, or between the first zone and the third zone so that terry loop knitting is continuous with either the mesh knitting or the jersey knitting. The first zone, the second zone, and the third zone may each include wool knitting. The terry loop knitting may be adapted to provide warmth in areas where it is needed, while the mesh knitting may be adapted to provide breathability in areas where it is needed. The jersey knitting may provide an intermediate level of warmth and breathability. However this is terry loop knit. Mesh knitting and jersey knitting combination—does not match our claims.

WO2019/213382A1 relates to a terry fabric with faux dobby and methods of making terry fabric with faux dobby. Described is a woven terry fabric article that includes a body having a first end and a second end opposite one another, and a first side edge and a second side edge opposite one another and generally perpendicular to the first and second opposite ends. The article further includes a first terry zone having a pile with a first pile height, a second terry zone having a pile with a second pile height, and a first faux dobby zone intermediate to the first and second terry zones. The first faux dobby zone has a pile with one or more pile heights that are visibly distinct from the pile heights of the first and second terry zones. In embodiments, the one or more pile heights in the faux dobby zone are less than the pile height of the adjacent zones, such as 50% less, 40% less, or 35% less.

Accordingly, there exists a need for woven terry fabrics, particularly towels with non-uniform weight distribution comprising different picks per centimeter and articles made there from.

OBJECTS OF INVENTION

It is the primary object of the present invention to provide a woven terry fabric comprising different picks per centimeter with non-uniform weight distribution.

It is another object of the present invention to provide improved terry fabric articles, such as towels, having desirable drying characteristics and aesthetics with reduced total weight as compared to the weight of the primary usage area.

It is another object of the present invention to provide improved terry fabric with reduced resources necessity to manufacture and launder the terry fabric articles.

It is another object of the present invention to provide a fabric having a controlled, non-uniform distribution of picks per centimeter either from side to side or end to end accomplished by varying the picks per centimeter of one or more of individual rows and groups of pile yarns.

It is another object of the present invention to vary the density of picks or pick density to provide terry fabric with reduced unit weight.

SUMMARY OF THE INVENTION

One or more of the problems of the conventional prior art may be overcome by various embodiments of the present invention.

It is the primary aspect of the present invention to provide a terry fabric with differential pick density, comprising:

- a body comprising of one or more ends of first end and second end, one or more edges of first side edge and second side edge, and a plurality of zones;
- a plurality of ground warp ends;
- a plurality of terry pile loop yarn; and
- a plurality of ground fill picks,
  - wherein the ground warp ends form a ground warp yarn, the terry pile loop yarns form terry pile loops, the ground fill picks are formed of a ground fill yarn, the ground warp ends and the ground fill picks form a ground fabric, the terry pile loops form a pile that projects from the surface of the ground fabric, the ground warp yarn, terry pile loop yarn, and ground fill yarn are woven together in a three-pick terry weave, and
  - wherein the plurality of zones extend across the fabric between the ends and edges, the plurality of zones comprises zones of differential pick density or non-uniform pick density, the pile with a picks per cm and loop density of one zone differs from the loop density in an adjacent zone, with zones comprising a lowest pick zone, a highest pick zone and first plurality of intermediate zones and second plurality of intermediate zones and the difference between the picks per cm in adjacent zones is in a range between about 0.1 picks per cm and about 10.1 picks per cm.

It is another aspect of the present invention, wherein the plurality of zones comprises of 'n' number of zones preferably a first zone of lowest pick density, a second zone of highest pick density and a third intermediate zone with pick density between the lowest and highest.

It is another aspect of the present invention, wherein the loop density of a zone is different from loop density of the adjacent zone.

It is another aspect of the present invention, wherein the intermediate zone is interspersed between first zones and second zones.

It is another aspect of the present invention, wherein the first zone comprises of a lowest picks per cm and the second zone comprises of a highest picks per cm and a first plurality of intermediate zones that are intermediate to the first zone and the second zone, and the third zone comprises of a picks per cm less than the Picks per cm of the second zone and a second plurality of intermediate zones that are intermediate to the third zone and the second zone.

It is another aspect of the present invention, wherein the picks per cm in each of the second plurality of intermediate zones incrementally increases from adjacent the third zone to adjacent the second zone.

It is another aspect of the present invention, wherein the zones extend between the edges of the terry fabric.

It is another aspect of the present invention, wherein the first plurality of intermediate zones is equal to the second plurality of intermediate zones.

It is another aspect of the present invention, wherein the first plurality of intermediate zones is unequal to the second plurality of intermediate zones.

It is another aspect of the present invention, wherein the fabric comprises of controlled, non-uniform distribution of picks per cm either from end to end or side edge to side edge accomplished by varying the picks per cm of one or more of individual rows and groups of pile yarns.

It is another aspect of the present invention, wherein the pick density between adjacent zones is selected from an ascending density pattern, descending density pattern, random density pattern and individual customized for a particular random pick density pattern.

It is another aspect of the present invention, wherein the non-uniform distribution of ascending density comprises of incremental increase in density from zones Z1 to Z2 and Z3 to Z2.

It is another aspect of the present invention, wherein the non-uniform distribution of descending density comprises of decreasing density from zones Z2 to Z1 & Z3.

It is another aspect of the present invention, wherein the random density pattern comprises of different density pattern in different zones, with pick density in adjacent zones kept different.

It is another aspect of the present invention, wherein the terry fabric is utilized to produce a terry fabric article comprises of bath mat, wash cloth, bath towel, hand towel, bath sheet and the like.

It is another aspect of the present invention, wherein the terry fabric is woven so as to decrease the unit weight in aggregate by decreasing the loops per square cm of one or more of rows, groups of pile that are outside of the primary use of the terry fabric article by differential pick and loop density.

It is another aspect of the present invention, wherein the woven terry fabric comprising yarn material defining ground fill, ground warp and pile warp is selected from one or more of natural material, synthetic material and combinations thereof.

It is another aspect of the present invention, wherein the yarn material comprises of one or more of hydrophilic fibers, synthetic fibers and blend thereof.

It is another aspect of the present invention, wherein the pick density between adjacent zones is in the range 0.1 PPCM to 5 PPCM.

It is another aspect of the present invention, wherein the picks per cm of the high density zone is in the range of 200 to 320% compared to the pick density of the low density zone.

It is another aspect of the present invention, wherein the fabric comprises of a terry ratio in the range of 2.5 to 11.5 and preferably between 3.1 and 10.5.

It is another aspect of the present invention, wherein the intermediate zones comprises of different pick densities and the number of zones with different pick densities are in the range of 6 zones to 46 zones.

It is another aspect of the present invention, wherein the terry loom weaves different pick density or picks per cm for every 36 to 72 pick insertions, corresponding to 12-24 loops at desired pick density per zone over a distance of about 1-2 inches.

It is another aspect of the present invention to provide a method of weaving a terry fabric comprising of the steps:

providing a plurality of ground warp ends;

providing a plurality of terry pile loop yarn;

providing a plurality of ground fill picks; and providing a body comprising of ends, edges and zones;

weaving the ground warp ends and the ground fill picks to form the ground fabric;

weaving terry pile loop yarns to form terry pile loops; and producing the fabric area forming plurality of zones with variable picks per centimeter and loop density, wherein the ground warp yarn, terry pile loop yarn, and ground fill yarn are woven together in a three-pick terry weave, and wherein the difference between the picks per cm in adjacent zones is in a range between about 0.1 picks per cm and about 10.1 picks per cm, and the terry loom weaves different picks per cm for every 36 to 72 pick insertions, corresponding to 12-24 loops at desired pick density per zone over a distance of about 1-2 inches.

BRIEF DESCRIPTION OF THE DRAWINGS

So that the manner in which the features, advantages and objects of the invention, as well as others which will become apparent, may be understood in more detail, more particular description of the invention briefly summarized above may be had by reference to the embodiment thereof which is illustrated in the appended drawings, which form a part of this specification. It is to be noted, however, that the drawings illustrate only a preferred embodiment of the invention and is therefore not to be considered limiting of the invention's scope as it may admit to other equally effective embodiments.

Figure 1:
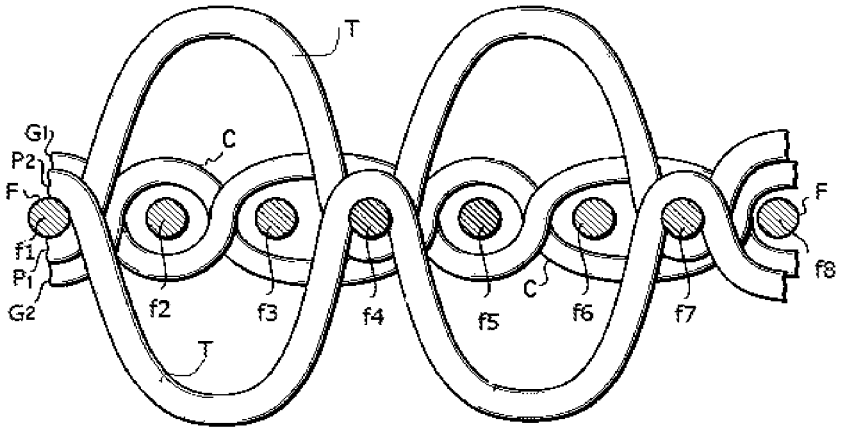
FIG. 1 illustrates a 3-pick terry cross-sectional view.

DESCRIPTION FOR DRAWINGS WITH REFERENCE NUMERALS (L1) First End
(L2) Second End
(W1) First side edge
(W2) Second side edge
(Z1) First Zone
(Z2) Second zone
(Z3) Third zone
(G1, G2) Ground warp ends
(P1, P2) Terry pile loop yarns
(f1, f2, f3, f4, f5, f6, f7, f8) Ground fill picks
(C) Ground warp yarn
(T) Terry pile loops
(F) Ground fill yarn
(N, . . . 1, 2, 3, 4, 5, 6) First plurality of intermediate zones
(Na, . . . 5*a*, 4*a*, 3*a*, 2*a*, 1*a*) Second plurality of intermediate zones

DETAILED DESCRIPTION OF THE INVENTION

The present invention generally relates to the field of textiles. More particularly, it relates to woven terry cloth with differential or non uniform pick density. The present invention provides for improved terry fabrics comprising different picks per centimeter and method for producing the same with controlled weight distribution. Additionally the present invention relates to variable density of picks in different zones of the fabric.

The terry fabric with differential pick density, comprises a body comprising of one or more ends of first end (L1) and second end (L2), one or more edges of first side edge (W1) and second side edge (W2), and a plurality of zones (Z1, Z2, Z3); a plurality of ground warp ends (G1, G2); a plurality of terry pile loop yarn (P1, P2); and a plurality of ground fill picks (f1, f2, f3, f4, f5, f6, f7, f8).

The ground warp ends G1, G2 are formed of yarn C, the terry pile loops T are formed of yams P1,P2, and the ground fill picks f1, f2, f3, f4, f5, f6, f7, f8 are formed of yarn F. The ground warp ends G1, G2 and the ground fill picks f1, f2, f3, f4, f5, f6, f7, f8 form the ground fabric. The terry pile loops T form the pile that projects from the surface of the ground fabric. As seen in FIG. 1, the ground warp yarn C, terry pile loop yarn P1,P2, and ground fill yarn F are woven together in a three-pick terry weave.

The plurality of zones (Z1, Z2, Z3) extend across the fabric between the ends (L1, L2) and edges (W1, W2), the plurality of zones (Z1, Z2, Z3) comprises zones of differential pick density or non-uniform pick density. The pile with a picks per cm and loop density of one zone differs from the loop density in an adjacent zone, with zones comprising a lowest pick zone, a highest pick zone and first plurality of intermediate zones (n . . . , 1, 2, 3, 4, 5, 6) and second plurality of intermediate zones (Na . . . , 5*a*, 4*a*, 3*a*, 2*a*, 1*a*) and the difference between the picks per cm in adjacent zones is in a range between about 0.1 picks per cm and about 10.1 picks per cm.

The plurality of zones comprises of 'n' number of zones preferably a first zone (Z1) of lowest pick density, a second zone (Z2) of highest pick density and a third intermediate zone (Z3) with pick density between the lowest and highest. The loop density of a zone is different from loop density of the adjacent zone. The intermediate zone (Z3) is interspersed between first zones (Z1) and second zones (Z2). The first zone (Z1) comprises of a lowest picks per cm and the second zone (Z2) comprises of a highest picks per cm and a first plurality of intermediate zones (N, . . . 1, 2, 3, 4, 5, 6) that are intermediate to the first zone (Z1) and the second zone (Z2), and the third zone (Z3) comprises of a picks per cm less than the Picks per cm of the second zone (z2) and a second plurality of intermediate zones (Na, . . . 5*a*, 4*a*, 3*a*, 2*a*, 1*a*) that are intermediate to the third zone (Z3) and the second zone (Z2).

The picks per cm in each of the second plurality of intermediate zones (Na, . . . 5*a*, 4*a*, 3*a*, 2*a*, 1*a*) incrementally increases from adjacent the third zone (Z3) to adjacent the second zone (Z2). The zones (Z1, N, . . . 1, 2, 3, 4, 5, Z2, Na . . . 5*a*, 4*a*, 3*a*, 2*a*, 1*a*, Z3) extend between the edges (W1, W2) of the terry fabric. The first plurality of intermediate zones (N, . . . 1, 2, 3, 4, 5, 6) is equal to the second plurality of intermediate zones (Na, . . . 5*a*, 4*a*, 3*a*, 2*a*, 1*a*). The first plurality of intermediate zones (N, . . . 1, 2, 3, 4, 5, 6) is unequal to the second plurality of intermediate zones (Na, . . . 5*a*, 4*a*, 3*a*, 2*a*, 1*a*). The fabric comprises of controlled, non-uniform distribution of picks per cm either from end to end (L1, L2) or side edge to side edge (W1, W2) accomplished by varying the picks per cm of one or more of individual rows and groups of pile yarns. The pick density between adjacent zones is selected from an ascending density pattern, descending density pattern, random density pattern and individual customized for a particular random pick density pattern. The non-uniform distribution of ascending density comprises of incremental increase in density from zones Z1 and Z3 to Z2. The non-uniform distribution of descending density comprises of decreasing density from zone Z2 to Z1 and Z3. The random density pattern comprises of different density pattern in different zones, with pick density in adjacent zones kept different.

The terry fabric is utilized to produce a terry fabric article comprises of bath mat, wash cloth, bath towel, hand towel, bath sheet and the like. The terry fabric is woven so as to decrease the unit weight in aggregate by decreasing the loops per square cm of one or more of rows, groups of pile that are outside of the primary use of the terry fabric article by differential pick and loop density. The woven terry fabric comprising yarn material defining ground fill, ground warp and pile warp is selected from one or more of natural material, synthetic material and combinations thereof. The yarn material comprises of one or more of hydrophilic fibers, synthetic fibers and blend thereof. The pick density between adjacent zones is in the range 0.1 PPCM to 5 PPCM. The picks per cms of the high density zone are in the range of 200-320% compared to the pick density of the low density zone. The fabric comprises of a terry ratio in the range of 2.5 to 11.5 and preferably between 3.1 and 10.5. The intermediate zones (N, . . . 1, 2, 3, 4, 5, 6, Na, . . . 5, 4, 3, 2, 1 . . . ) comprises of different pick densities and the number of zones with different pick densities are in the range of 6 zones to 46 zones. The terry loom weaves different pick density or picks per cm for every 36 to 72 pick insertions, corresponding to 12-24 loops at desired pick density per zone over a distance of about 1-2 inches.

The method of weaving a terry fabric comprising of the steps: providing a plurality of ground warp ends (G1, G2); providing a plurality of terry pile loop yarn (P1, P2); providing a plurality of ground fill picks (f1, f2, f3, f4, f5, f6, f7, f8); providing a body comprising of ends (L1, L2), edges (W1, W2) and zones (Z1, Z2, Z3); weaving the ground warp ends (G1, G2) and the ground fill picks (f1, f2, f3, f4, f5, f6, f7, f8) to form the ground fabric; weaving terry pile loop yarns (P1, P2) to form terry pile loops (T); and processing the fabric area forming plurality of zones with variable picks per centimeter and loop density.

The ground warp yarn (C), terry pile loop yarn (P1, P2), and ground fill yarn (F) are woven together in a three-pick terry weave. The difference between the picks per cm in adjacent zones is in a range between about 0.1 picks per cm and about 10.1 picks per cm, and the terry loom weaves different pick density or picks per cm for every 36 to 72 pick insertions, corresponding to 12-24 loops at desired pick density per zone over a distance of about 1-2 inches.

With reference to FIG. 1 a terry fabric is woven in a three-pick terry weave, As shown in FIG. 1. The ground warp ends (G1, G2) are formed of yarn C, the terry pile loops T are formed of yams (P1, P2), and the ground fill picks (f1, f2, f3, f4, f5, f6, f7, f8) are formed of yarn (F). The ground warp ends G1,G2 and the ground fill picks (f1, f2, f3, f4, f5, f6, f7, f8) form the ground fabric. The terry pile loops (T) form the pile that projects from the surface of the ground fabric. As seen in FIG. 1, the ground warp yarn C, terry pile loop yarn (P1, P2), and ground fill yarn F are woven together in a three-pick terry weave. Although FIG. 1 illustrates part of a single warp wise row, the ground warp ends and terry pile loops of the other rows of the terry fabric may be constructed and arranged as shown in FIG. 2.

Figure 2:
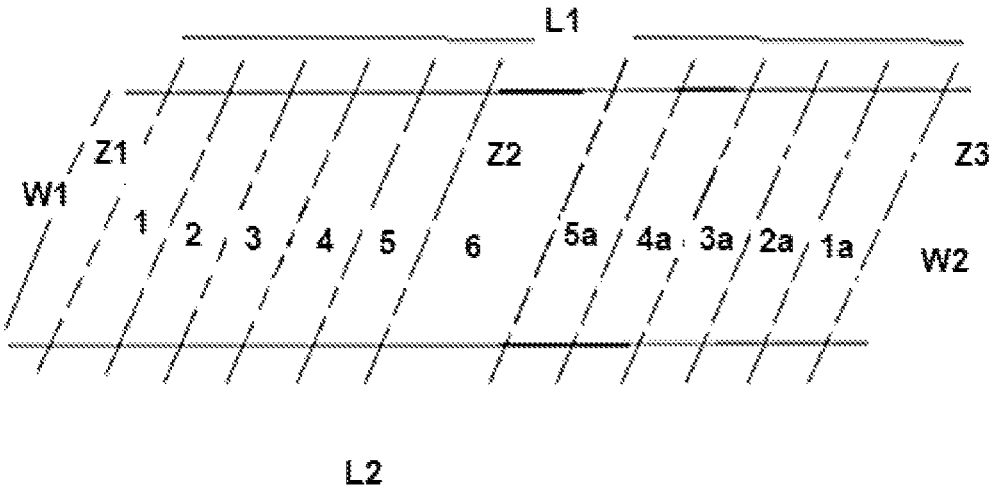
FIG. 2 illustrates a perspective view of a schematic representation of a terry fabric towel in accordance with the principles of the invention.
Figure 3:
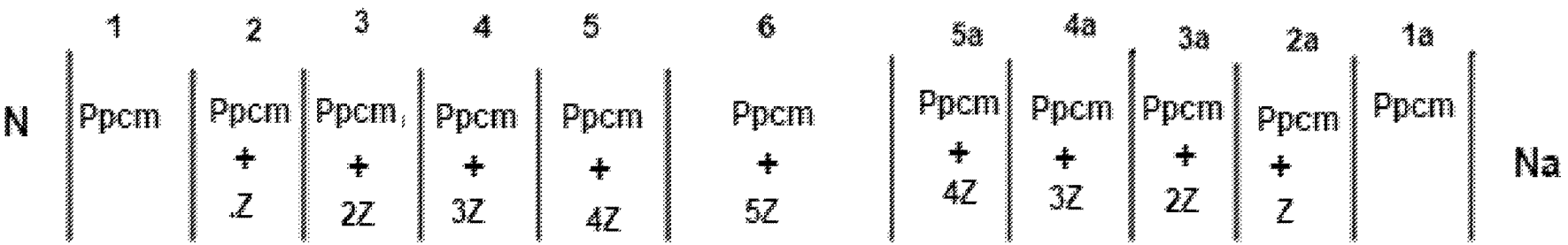
FIG. 3 illustrates a partial, cross-sectional view, not to scale, of a portion of the terry fabric towel.

The exemplary towel in FIGS. 2 & 3 has a body with lengths/ends (L1, L2) extending between the opposite ends of the towel and a widths/edges (W1, W2) extending between opposite side edges of the towel. The body of the towel is illustrated as being divided into a plurality of zones (1,1*a*, 2,2*a*, 3,3*a* 4,4*a*, 5,5*a* and 6) that each extend across the width of the towel. It will be appreciated that the terry fabric could be formed in which the zones (1,1*a*, 2,2*a*, 3,3*a* 4,4*a*, 5,5*a* and 6) extend across the length (L1, L2) of the body of the towel instead of the width W.

FIG. 3 illustrates an exemplary embodiment of a terry fabric article, in particular, a towel formed from the terry fabric with lines indicating otherwise non-apparent transitions between zones. FIG. 3 illustrating the differences in picks per centimeter between adjacent zones of terry fabric.

In the illustrated embodiment, the piles in the end zones (1,1*a*) of the body of the towel have a Picks per centimeter PPCM that is the lowest picks per centimeter in the towel. In the first intermediate zones (2, 2*a*) that are adjacent to the end zones (1, 1*a*), the picks per centimeter (PPCM) increases by an increment (Z) that is not apparent upon casual visual inspection. The Picks per centimeter in the first intermediate zones (2, 2*a*) is thus equal to PPCM+Z. In the second intermediate zones (3, 3*a*) that are adjacent to the first intermediate zones (2, 2*a*), the Picks per centimeter increases by another increment, designated here as 2Z, relative to the picks per centimeter PPCM in the preceding zones, (i.e., first intermediate zones 2, 2*a*). The picks per centimeter in the second intermediate zones (3, 3*a*) are thus equal to PPCM+2Z. In the third intermediate zones (4, 4*a*) that are adjacent to the second intermediate zones (3, 3*a*), the Picks per centimeter increases by another increment, designated here as 3z, relative to the picks per centimeter (PPCM) in the preceding zones (i.e., second intermediate zones 3, 3*a*). The Picks per centimeter third intermediate zones (4, 4*a*) is thus equal to PPCM+3z.

In the fourth intermediate zones (5, 5*a*) that are adjacent to the third intermediate zones (4, 4*a*), the picks per centimeter increases by another increment, designated here as 4z, relative to the picks per centimeter PPCM in the preceding zones (i.e., third intermediate zones 4, 4*a*). The Picks per centimeter in the third intermediate zones (5, 5*a*) is thus equal to PPCM+4z.

In the central zone that is adjacent to the fourth intermediate zones (5, 5*a*), the picks per centimeter increases by another increment, designated here as 5Z, relative to the picks per centimeter [PPCM] in the preceding zones (i.e., fourth intermediate zones 5, 5*a*). The picks per centimeter in the central zone (6) are thus equal to PPCM+5Z. The central zone (6) has the highest picks per centimeter in the body of the towel.

While the incremental increases (Z, 2Z, 3Z, 4Z and 5Z) in picks per centimeter (PPCM) are illustrated as being the same across all zones (1, 1*a*, 2, 2*a*, 3, 3*a*, 4,4*a*, 5,5*a*,6), it will be appreciated that the incremental increases in picks per centimeter between adjacent zones need not be identical across all zones. For example, the incremental increase Z in picks per centimeter between the end zones (1, 1*a*) and the first intermediate zones (2, 2*a*) may equal a first value and the incremental increase (2Z) between the first intermediate zones (2, 2*a*) and the second intermediate zones (3, 3*a*) may be a second value that is greater or smaller than the first value so long as the incremental increase Z, 2Z, 3Z, 4Z between adjacent zones (1, 1*a*, 2, 2*a*, 3, 3*a*, 4, 4*a*,5,5*a* and 6) is not readily apparent upon casual visual inspection of the body of the towel.

As described above, the differences (i.e., incremental increases Z, 2Z, 3Z, 4Z, 5Z) between the Picks per centimeters (PPCM) in adjacent zones (1, 1*a*, 2, 2*a*, 3, 3*a*, 4, 4*a*,5,5*a*,6) of the body of the towel are small enough that the differences are not readily apparent upon casual visual inspection of the towel.

With the increase in PPCM the, number of terry loops per zone will increase accordingly leading to gradual increase in weight in each zone.

In an embodiment, the difference in picks per centimeter between adjacent zones may range between about 0.1 PPCM and about 5 PPCM and accordingly no. of loops and weight.

In another embodiment, the difference in Picks per centimeter between adjacent zones may range between about 0.1 PPCM and about 4 PPCM. In another embodiment, the difference in Picks per centimeter between adjacent zones may range between about 0.1 PPCM and about 3 PPCM. In another embodiment, the difference in Picks per centimeter between adjacent zones may range between about 0.1 PPCM and about 2.5 PPCM. In another embodiment, the difference in Picks per centimeter between adjacent zones may range between about 0.1 PPCM and about 2 PPCM. In another embodiment, the difference in Picks per centimeter between adjacent zones may range between about 0.1 PPCM and about 1.5 PPCM. In another embodiment, the difference in picks per centimeter between adjacent zones may range between about 0.1 PPCM and about 1 PPCM. In another embodiment, the difference in Picks per centimeter between adjacent zones may range between about 0.1 PPCM and about 0.8 PPCM. In another embodiment, the difference in picks per centimeter between adjacent zones may range between about 0.1 PPCM and about 0.5 PPCM. In another embodiment, the difference in Picks per centimeter between adjacent zones may range between about 0.1 PPCM and about 0.4 PPCM. In another embodiment, the difference in Picks per centimeter between adjacent zones may range between about 0.1 PPCM and about 0.2 PPCM.

In the illustrated embodiment, the central zone (6) has the highest picks per centimeter/no of loops/weight in the body of the towel. In an embodiment, the Picks per centimeter in the zone with the highest Picks per centimeter is not less than about 110% or not more than 200 to 320% of the Picks per centimeter in the zone with the lowest Picks per centimeter.

In an embodiment, the Picks per centimeter in the zone with the highest Picks per centimeter is not less than about 125% or not more than about 250% of the Picks per centimeter in the zone with the lowest Picks per centimeter. For example, if the Picks per centimeter in the end zones (1, 1*a*) of the illustrated embodiment are about 11 PPCM, the Picks per centimeter of the central zone may range between about 13.75 PPCM and about 27.5 PPCM. In another embodiment, the Picks per centimeter in the zone with the highest Picks per centimeter is not less than about 125% or not more than about 200% of the Picks per centimeter in the zone with the lowest Picks per centimeter.

The Picks per centimeter also be considered as a function of the terry ratio, which is an expression of the length of yarn consumed for the pile as compared to the ground warp. In an embodiment of the invention, the fabric may have a terry ratio which ranges between about 2.5 and about 11.5. In another embodiment, the fabric may have a terry ratio which ranges between about 3.1 and 10.5.

In the illustrated embodiment, end zone (1), first intermediate zone (2, the second intermediate zone (3), the third intermediate zone (4), the fourth intermediate zone (5), and the central zone (6) each have a different Picks per centimeter with the end zone (1) having the lowest Picks per centimeter and the central zone (6) having the highest Picks per centimeter. These Picks per centimeters correspond with the Picks per centimeters in the zones at the opposite end of the towel, i.e., end zone (1), first intermediate zone (2), the second intermediate zone (3), the third intermediate zone (4), the fourth intermediate zone (5). Thus, the illustrated embodiment utilizes Six different Picks per centimeters spread across the end zones (1, 1*a*), intermediate zones (2, 2*a*, 3, 3*a*, 4, 4*a*, 5,5*a*) and the central zone (6). It will be appreciated that a different number of zones, each having a different Picks per centimeter relative to their respective adjacent zones may be used. In an embodiment, at least four zones from the end zones to the central zone having four different Picks per centimeters are used. In another embodiment, at least eight zones from the end zones to the central zone having eight different Picks per centimeters are used. In another embodiment, at least twelve zones from the end zones to the central zone having twelve different Picks per centimeters are used. In another embodiment, at least sixteen zones from the end zones to the central zone having sixteen different Picks per centimeters are used. In another embodiment, at least twenty zones from the end zones to the central zone having twenty different Picks per centimeters are used. In another embodiment, the number of zones between the end zones and the central zone may range between 2 zones and forty eight zones. In another embodiment, the number of zones between the end zones and the central zone may range between 4 zones and forty six zones. In another embodiment, the number of zones between the end zones and the central zone may range between six zones and forty six zones. In another embodiment, the number of zones between the end zones and the central zone may range between 8 zones and forty six zones.

Furthermore, while the illustrated towel has a central zone (6) surrounded by an equal number of intermediate zones (1, 1*a*, 2,2*a*, 3,3*a*,4,4*a*,5,5*a*) between the central zone (6) and the two end zones (1, 1*a*), the towel could have an unequal number of intermediate zones between the central zone (6) and the end zones (1, 1*a*).

It is further contemplated that the Picks per centimeters in adjacent zones may not necessarily increase from one zone to the next across a plurality of zones. In other words, the Picks per centimeters across a plurality of zones may alternate between lower Picks per centimeters and higher Picks per centimeters. For example, the towel illustrated in FIG. 3 could be produced such that the Picks per centimeters in zones 1 and 4 are higher or lower than the Picks per centimeter in zones 2 and 5. This pattern of alternating Picks per centimeters could continue along the entire length L of the body of the towel or along a portion of the length of the towel. To exemplify this latter point, the Picks per centimeters could alternate in the end zones (1, 1*a*), the first intermediate zones (2, 2*a*) and the second intermediate zones (3, 3*a*) and then the Picks per centimeters could increase incrementally from the second intermediate zones (3, 3*a*), and the third intermediate zones (4, 4*a*) and then the Picks per centimeters could increase incrementally from the second intermediate zones (3, 3*a*), across the third intermediate zones (5, 5*a*), to the central zone (6). These alternative embodiments maintain the spirit of the invention that the difference between Picks per centimeters in adjacent zones is not readily apparent upon casual visual inspection.

The yarns defining the ground fill, ground warp, and pile warp of embodiments of the terry fabric may be made of any suitable material including yarns made of natural material, synthetic material, and combinations thereof. In an embodiment, at least a portion of the yarns include hydrophilic fibers, such as cotton or other cellulosic fibers that may optionally be blended with synthetic yarns such as polyester in spun or filament yarn form. Such yarns are known in the art. Further, depending upon the desired characteristic of the fabric the ground fill and ground warp may be selected of appropriate materials and the pile warp may be selected of the same or different materials, likewise any combination of yarns may be utilized to define the ground fill, ground warp, and pile warp as desired.

The terry fabrics described herein may be used to manufacture any sort of terry fabric article, such as bath mats, wash cloths, and towels including bath sheets, bath towels, hand towels, and dish towels.

As the fabric is woven, the Picks per centimeter for each zone (1, 1*a*, 2, 2*a*, 3, 3*a*, 4, 4*a*,5,5*a*, 6) of the body of the towel is woven to have the desired picks per centimeter. In an embodiment, terry fabric is woven on a terry loom capable of weaving the terry fabric with the desired Picks per centimeter in each zone. In an embodiment, the terry loom weaves a different Picks per centimeter for every 36 to 72 pick insertions, which corresponds to about 12 loops to about 24 loops at the desired picks per centimeter in the zone over a distance of about 1 inch to about 2 inches. The number of pick insertions and corresponding loops per zone may be adjusted as necessary to result in zones having the desired widths as discussed above.

The incremental increases Z, 2Z, 3Z, 4Z, 5Z in Picks per centimeter from the end zones (1, 1*a*) to the central zone (6) result in a towel wherein the difference in the Picks per centimeter in the end zones (1, 1*a*) of the towel compared to the central zone 6 will not be readily apparent to the user of the towel upon casual visual inspection. Moreover, since most people dry themselves with the central area of towels, which corresponds to the central zone 6 of the presently described towel most people using the resulting towels will experience the same performance qualities as they would experience if the towel had been woven with a uniform Picks per centimeter from end to end that matches the Picks per centimeter in the central zone (6) The resulting towel has the further benefit of requiring less material to manufacture as less yarn will be needed to weave the fabric for the towel due to the lower average Picks per centimeters. Further, the lower average Picks per centimeters will decrease the weight of the towels which will decrease the resources necessary for laundering the towels. This has environmental consequences as less soap and water will be necessary to wash the towels and less energy will be needed to dry the towels. This is especially helpful in institutional settings wherein laundering is paid based on the weight of the laundered items. The significant weight reductions in the towel will result in significant savings for institutional users of the towel, such as hotels and hospitals, which launder large quantities of towels every day. Thus, the resulting towel provides the same user benefits as heavier towels while reducing the resources required in manufacturing and laundering the towel.

By virtue of the foregoing, there is thus provided a woven terry fabric with controlled weight distribution by altering picks per centimeter and terry fabric articles, such as towel, having advantages over prior woven terry fabrics and terry fabric articles.

The present invention provides a woven terry fabric wherein the body comprises of opposing ends and opposing side edges. A woven terry fabric wherein the side edges are perpendicular to the ends. A woven terry fabric wherein the zones extend across the fabric between one or more of ends and side edges. A woven terry fabric wherein the fabric area comprises plurality of zones differing in picks per centimeter and loop density between each other. A woven terry fabric wherein the difference between picks per centimeter in adjacent zones is of range about 0.1 picks per centimeter and 10.1 picks per centimeter. a woven terry fabric wherein the picks per cms of the high density zone is about 200-320% the pick density of the low density zone. A woven terry fabric wherein the plurality of zones includes a first zone comprising a lowest picks per centimeter, a second zone comprising highest picks per centimeter and a first plurality of intermediates zones which are intermediate to the first zone and second zone. A woven terry fabric wherein the intermediate zones at least 6 intermediate zones. A woven terry fabric wherein the intermediate zones comprise of different pick densities and the number of zones with different pick densities may be 6 zones to 46 zones. A woven terry fabric wherein the picks per centimeter in each of the second plurality of intermediate zones incrementally increases from adjacent of third zone to adjacent of second zone. A woven terry fabric wherein the intermediate zones comprise of different pick densities and the number of zones with different pick densities may be 6 zones to 46 zones. A woven terry fabric wherein the pick density between adjacent zones is in the range 0.1 PPCM to 5 PPCM. A woven terry fabric wherein the fabric may have a terry ratio in the range of 2.5 to 11.5 and preferably between 3.1 and 10.5. The terry fabrics described herein may be used to manufacture any sort of terry fabric article, such as bath mats, wash cloths, and towels including bath sheets, bath towels, hand towels, and dish towels. A woven terry fabric wherein the picks per cms of the high density zone is about 200 to 320% the pick density of the low density zone. The terry fabric includes a repeated weave sequence comprising first and second interlacing arrangements.

The present invention provides a woven terry fabric wherein the body comprises of opposing ends and opposing side edges. A woven terry fabric wherein the side edges are perpendicular to the ends. A woven terry fabric wherein the zones extend across the fabric between one or more of ends and side edges. A woven terry fabric wherein the fabric area comprises plurality of zones differing in picks per centimeter and loop density between each other. A woven terry fabric wherein the difference between picks per centimeter in adjacent zones is of range about 0.1 picks per centimeter and 10.1 picks per centimeter. a woven terry fabric wherein the picks per cms of the high density zone is about 200 to 320% the pick density of the low density zone.

At the outset of the description that follows, it is to be understood that the ensuing description only illustrates a particular form of this invention. However, such a particular form is only an exemplary embodiment and is not intended to be taken restrictively to imply any limitation on the scope of the present invention. Additional advantages and modifications will readily appear to those skilled in the art. For example, although the drawings illustrate a three-pick terry-weave pattern, any suitable pattern may be used to form the woven terry fabric.

Although, the invention has been described and illustrated with respect to the exemplary embodiments thereof, it should be understood by those skilled in the art that the foregoing and various other changes, omissions and additions may be made therein and thereto, without parting from the spirit and scope of the present invention.

I claim:

1. A terry fabric with differential pick density, comprising:

a body comprising of one or more ends of first end (L1) and second end (L2), one or more edges of first side edge (W1) and second side edge (W2), and a plurality of zones (Z1, Z2, Z3);

a plurality of ground warp ends (G1, G2);

a plurality of terry pile loop yarn (P1, P2); and a plurality of ground fill picks (f1, f2, f3, f4, f5, f6, f7, f8), wherein the ground warp ends (G1, G2) form a ground warp yarn (C), the terry pile loop yarns (P1, P2) form terry pile loops (T), the ground fill picks (f1, f2, f3, f4, f5, f6, f7, f8) are formed of a ground fill yarn (F), the ground warp ends (G1, G2) and the ground fill picks (F) form a ground fabric, the terry pile loops (T) form a pile that projects from the surface of the ground fabric, the ground warp yarn (C), terry pile loop yarn (P1, P2), and ground fill yarn (F) are woven together in a three-pick terry weave, and wherein the plurality of zones (Z1, Z2, Z3) extend across the fabric between the ends (L1, L2) and edges (W1, W2), the plurality of zones (Z1, Z2, Z3) comprises zones of differential pick density or non-uniform pick density, the pile with a picks per cm and loop density of one zone differs from the loop density in an adjacent zone, with zones comprising a lowest pick zone, a highest pick zone and first plurality of intermediate zones (n . . . , 1, 2, 3, 4, 5, 6) and second plurality of intermediate zones (Na . . . , 5*a*, 4*a*, 3*a*, 2*a*, 1*a*) and the difference between the picks per cm in adjacent zones is in a range between about 0.1 picks per cm and about 10.1 picks per cm.

2. The terry fabric with differential pick density as claimed in claim 1, wherein the plurality of zones comprises of 'n' number of zones preferably a first zone (Z1) of lowest pick density, a second zone (Z2) of highest pick density and a third intermediate zone (Z3) with pick density between the lowest and highest.

3. The terry fabric with differential pick density as claimed in claim 1, wherein the loop density of a zone is different from loop density of the adjacent zone.

4. The terry fabric with differential pick density as claimed in claim 2, wherein the intermediate zone (Z3) is interspersed between first zones (Z1) and second zones (Z2).

5. The terry fabric with differential pick density as claimed in claim 1, wherein the first zone (Z1) comprises of a lowest picks per cm and the second zone (Z2) comprises of a highest picks per cm and a first plurality of intermediate zones (N, . . . 1, 2, 3, 4, 5, 6) that are intermediate to the first zone (Z1) and the second zone (Z2), and the third zone (Z3) comprises of a picks per cm less than the Picks per cm of the second zone (z2) and a second plurality of intermediate zones (Na, . . . 5*a*, 4*a*, 3*a*, 2*a*, 1*a*) that are intermediate to the third zone (Z3) and the second zone (Z2).

6. The terry fabric with differential pick density as claimed in claim 5, wherein the picks per cm in each of the second plurality of intermediate zones (Na, . . . 5*a*, 4*a*, 3*a*, 2*a*, 1*a*) incrementally increases from adjacent the third zone (Z3) to adjacent the second zone (Z2).

7. The terry fabric with differential pick density as claimed in claim 5, wherein the zones (Z1, N, . . . 1, 2, 3, 4, 5, Z2, Na . . . 5*a*, 4*a*, 3*a*, 2*a*, 1*a*, Z3) extend between the edges (W1, W2) of the terry fabric.

8. The terry fabric with differential pick density as claimed in claim 1, wherein the first plurality of intermediate zones (N, . . . 1, 2, 3, 4, 5, 6) is equal to the second plurality of intermediate zones (Na, . . . 5*a*, 4*a*, 3*a*, 2*a*, 1*a*).

9. The terry fabric with differential pick density as claimed in claim 1, wherein the first plurality of intermediate zones (N, . . . 1, 2, 3, 4, 5, 6) is unequal to the second plurality of intermediate zones (Na, . . . 5*a*, 4*a*, 3*a*, 2*a*, 1*a*).

10. The terry fabric with differential pick density as claimed in claim 1, wherein the fabric comprises of controlled, non-uniform distribution of picks per cm either from end to end (L1, L2) or side edge to side edge (W1, W2) accomplished by varying the picks per cm of one or more of individual rows and groups of pile yarns.

11. The terry fabric with differential pick density as claimed in claim 1, wherein the pick density between adjacent zones is selected from an ascending density pattern, descending density pattern, random density pattern and individual customized for a particular random pick density pattern.

12. The terry fabric with differential pick density as claimed in claim 11, wherein the non-uniform distribution of ascending density comprises of incremental increase in density from zones Z1 to Z2 and Z3 to Z2.

13. The terry fabric with differential pick density as claimed in claim 11, wherein the non-uniform distribution of descending density comprises of decreasing density from zones Z2 to Z1 & Z3.

14. The terry fabric with differential pick density as claimed in claim 11, wherein the random density pattern comprises of different density pattern in different zones, with pick density in adjacent zones kept different.

15. The terry fabric with differential pick density as claimed in claim 1, wherein the terry fabric is utilized to produce a terry fabric article comprises of bath mat, wash cloth, bath towel, hand towel, bath sheet and the like.

16. The terry fabric with differential pick density as claimed in claim 1, wherein the terry fabric is woven so as to decrease the unit weight in aggregate by decreasing the loops per square cm of one or more of rows, groups of pile that are outside of the primary use of the terry fabric article by differential pick and loop density.

17. The terry fabric with differential pick density as claimed in claim 1, wherein the woven terry fabric comprising yarn material defining ground fill, ground warp and pile warp is selected from one or more of natural material, synthetic material and combinations thereof.

18. The terry fabric with differential pick density as claimed in claim 1, wherein the yarn material comprises of one or more of hydrophilic fibers, synthetic fibers and blend thereof.

19. The terry fabric with differential pick density as claimed in claim 1, wherein the pick density between adjacent zones is in the range 0.1 PPCM to 5 PPCM.

20. The terry fabric with differential pick density as claimed in claim 1, wherein the picks per cm of the high density zone is in the range of 200 to 320% compared to the pick density of the low density zone.

21. The terry fabric with differential pick density as claimed in claim 1, wherein the fabric comprises of a terry ratio in the range of 2.5 to 11.5 and preferably between 3.1 and 10.5.

22. The terry fabric with differential pick density as claimed in claim 1, wherein the intermediate zones (N, . . . 1, 2, 3, 4, 5, 6, Na, . . . 5, 4, 3, 2, 1 . . . ) comprises of different pick densities and the number of zones with different pick densities are in the range of 6 zones to 46 zones.

23. The terry fabric with differential pick density as claimed in claim 1, wherein the terry loom weaves different pick density or picks per cm for every 36 to 72 pick insertions, corresponding to 12-24 loops at desired pick density per zone over a distance of about 1-2 inches.

24. A method of weaving a terry fabric comprising of the steps:

providing a plurality of ground warp ends (G1, G2);

providing a plurality of terry pile loop yarn (P1, P2);

providing a plurality of ground fill picks (f1, f2, f3, f4, f5, f6, f7, f8); and providing a body comprising of ends (L1, L2), edges (W1, W2) and zones (Z1, Z2, Z3);

weaving the ground warp ends (G1, G2) and the ground fill picks (f1, f2, f3, f4, f5, f6, f7, f8) to form the ground fabric;

weaving terry pile loop yarns (P1, P2) to form terry pile loops (T); and producing the fabric area forming plurality of zones with variable picks per centimeter and loop density, wherein the ground warp yarn (C), terry pile loop yarn (P1, P2), and ground fill yarn (F) are woven together in a three-pick terry weave, and wherein the difference between the picks per cm in adjacent zones is in a range between about 0.1 picks per cm and about 10.1 picks per cm, and the terry loom weaves different picks per cm for every 36 to 72 pick insertions, corresponding to 12-24 loops at desired pick density per zone over a distance of about 1-2 inches.

* * * * *